US007431017B2

(12) United States Patent
Gibson

(10) Patent No.: US 7,431,017 B2
(45) Date of Patent: Oct. 7, 2008

(54) MULTI-SOURCE FUEL SYSTEM HAVING CLOSED LOOP PRESSURE CONTROL

(75) Inventor: Dennis H. Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/420,051

(22) Filed: May 24, 2006

(65) Prior Publication Data

US 2007/0272213 A1 Nov. 29, 2007

(51) Int. Cl.
*F02M 37/00* (2006.01)

(52) U.S. Cl. ..... 123/446; 123/447

(58) Field of Classification Search ..... 123/446, 123/456, 506, 496, 447, 500, 501
See application file for complete search history.

(56) References Cited

U.S. PATENT DOCUMENTS

| | | | | |
|---|---|---|---|---|
| 3,000,319 | A | 9/1961 | Tuck | |
| 3,105,441 | A | 10/1963 | Grill et al. | |
| 4,083,345 | A | 4/1978 | Davis | |
| 4,338,231 | A | 7/1982 | Marzocchi et al. | |
| 5,094,216 | A | 3/1992 | Miyaki et al. | |
| 5,277,156 | A | 1/1994 | Osuka et al. | |
| 5,404,855 | A | 4/1995 | Yen et al. | |
| 5,433,182 | A | 7/1995 | Augustin et al. | |
| 5,441,027 | A | 8/1995 | Buchanon et al. | |
| 5,460,133 | A | 10/1995 | Perr et al. | |
| 5,592,968 | A | 1/1997 | Nakashima et al. | |
| 5,603,303 | A | 2/1997 | Okajima et al. | |
| 5,622,152 | A * | 4/1997 | Ishida | 123/446 |
| 5,642,714 | A | 7/1997 | Buckley | |
| 5,727,525 | A | 3/1998 | Tsuzuki | |
| 5,732,679 | A | 3/1998 | Takahasi et al. | |

(Continued)

FOREIGN PATENT DOCUMENTS

DE 199 39 422 A1 3/2001

(Continued)

OTHER PUBLICATIONS

B. Mahr (Robert Bosch GmbH, Diesel Systems, DS-NF/SBN, Postfach 30 02 20, D-70469 Stuttgart, Germany), "Future and Potential of Diesel Injection Systems", THIESEL 2002 Conference on Thermo- and Fluid-Dynamic Process in Diesel Engines, Sep. 2002, pp. 5-17, Valencia, Spain.

(Continued)

*Primary Examiner*—Carl S. Miller
(74) *Attorney, Agent, or Firm*—Finnegan, Henderson, Farabow, Garrett & Dunner

(57) ABSTRACT

A fuel system for an engine is disclosed. The fuel system has a first source of fuel at a first pressure, and a second source of fuel at a second pressure. The fuel system also has a fuel injector configured to receive fuel from the first and second sources and inject fuel into a combustion chamber of the engine. The fuel system further has a valve operable to selectively direct fuel from the first and second sources to the fuel injector. The fuel system additionally has a controller in communication with the valve and being configured to affect operation of the valve and a resulting fuel pressure based on a desired injection pressure.

15 Claims, 3 Drawing Sheets

U.S. PATENT DOCUMENTS

| | | | | |
|---|---|---|---|---|
| 5,983,863 | A | 11/1999 | Cavanagh et al. | |
| 6,092,509 | A * | 7/2000 | Tanabe et al. | 123/447 |
| 6,095,118 | A | 8/2000 | Klinger et al. | |
| 6,112,721 | A | 9/2000 | Kouketsu et al. | |
| 6,253,735 | B1 | 7/2001 | Miyajima | |
| 6,311,674 | B1 | 11/2001 | Igashira et al. | |
| 6,357,421 | B1 | 3/2002 | Pritchard | |
| 6,427,660 | B1 | 8/2002 | Yang | |
| 6,491,017 | B1 | 12/2002 | Mahr et al. | |
| 6,505,608 | B2 | 1/2003 | Hiraku et al. | |
| 6,520,152 | B1 | 2/2003 | Mahr et al. | |
| 6,619,263 | B1 | 9/2003 | Mahr et al. | |
| 6,684,855 | B2 * | 2/2004 | Murakami et al. | 123/446 |
| 6,792,919 | B2 | 9/2004 | Kohketsu et al. | |
| 6,832,599 | B2 * | 12/2004 | Ibrahim et al. | 123/456 |
| 6,889,656 | B1 * | 5/2005 | Rembold et al. | 123/446 |
| 6,895,937 | B2 | 5/2005 | Namekawa et al. | |
| 6,899,084 | B2 | 5/2005 | Miyashita | |
| 6,973,921 | B2 | 12/2005 | Shafer et al. | |
| 7,146,963 | B2 | 12/2006 | Tahara | |
| 7,150,268 | B2 | 12/2006 | Shafer et al. | |
| 7,179,060 | B2 | 2/2007 | Sommars et al. | |
| 7,182,067 | B2 | 2/2007 | Ricco et al. | |
| 2004/0163626 | A1 | 8/2004 | Stockner et al. | |
| 2004/0168673 | A1 | 9/2004 | Shinogle | |
| 2005/0115544 | A1 | 6/2005 | Kim | |
| 2005/0126545 | A1 | 6/2005 | Shafer et al. | |
| 2007/0101968 | A1 | 5/2007 | Gibson et al. | |

FOREIGN PATENT DOCUMENTS

| | | | |
|---|---|---|---|
| DE | 199 45 673 | A1 | 5/2001 |
| EP | 0 643 221 | B1 | 4/1998 |
| EP | 1 273 797 | A2 | 1/2003 |
| EP | 1389680 | A2 | 2/2004 |
| EP | 1 522 719 | A1 | 4/2005 |
| JP | 6-93936 | | 5/1994 |
| WO | WO 01/24320 | A1 | 4/2001 |
| WO | WO 2007/055805 | | 5/2007 |

OTHER PUBLICATIONS

Research Disclosure, Nov. 2004, No. 487, www.researchdisclosure.com, Kenneth Mason Publications Ltd.; Westbourne, Hampshire, UK.

PCT International Search Report for PCT/US2006/036727 mailed Jan. 22, 2007.

PCT International Search Report for PCT/US2007/012029 mailed Dec. 7, 2007.

* cited by examiner

MULTI-SOURCE FUEL SYSTEM HAVING CLOSED LOOP PRESSURE CONTROL

TECHNICAL FIELD

The present disclosure is directed to a fuel system and, more particularly, to a fuel system having multiple sources of pressurized fuel for providing variable pressure injection events, and closed loop injection pressure control.

BACKGROUND

Common rail fuel systems provide a way to introduce fuel into the combustion chambers of an engine. Typical common rail fuel systems include an injector having an actuating solenoid that opens a fuel nozzle when the solenoid is energized. Fuel is then injected into the combustion chamber as a function of the time period during which the solenoid remains energized and the pressure of fuel supplied to the fuel injector nozzle during that time period.

To optimize engine performance and exhaust emissions, engine manufacturers may vary the pressure of the fuel supplied to the fuel injector nozzle. One such example is described in U.S. Patent Application Publication No. 2004/0168673 (the '673 publication) by Shinogle published Sep. 2, 2004. The '673 publication describes a fuel system having a fuel injector fluidly connectable to a first common rail holding a supply of fuel, and a second common rail holding a supply of actuation fluid. Each fuel injector of the '673 publication is equipped with an intensifier piston movable by the actuation fluid to increase the pressure of the fuel. By fluidly connecting the fuel injector to the first common rail, fuel can be injected at a first pressure. By fluidly connecting the fuel injector to the first and second common rails, fuel can be injected at a second pressure that is higher than the first pressure. The pressure of the fuel and the actuation fluid within the first and second common rails may be sensed via one or more pressure sensors and regulated through output control of corresponding pumps.

Although the fuel injection system of the '673 publication may include two different supplies of pressurized fluid that cooperate to adequately supply fuel to an engine at two different pressures, it may, however, have limitations. Specifically, because the second pressure is achieved by intensifying the first pressure, the second pressure is dependent on the first pressure. This dependency may limit the ability to shape the rate of fuel injections with the system of the '673 publication. In addition, because the pressure of the injected fuel is regulated by controlling pump output a significant distance upstream of the injectors, the actual injected pressure may lag behind a desired injected pressure. This lag in pressure may result in injection profiles that deviate from intended injection profiles.

The fuel system of the present disclosure solves one or more of the problems set forth above.

SUMMARY OF THE INVENTION

One aspect of the present disclosure is directed to a fuel system for an engine. The fuel system includes a first source of fuel at a first pressure, and a second source of fuel at a second pressure. The fuel system also includes a fuel injector configured to receive fuel from the first and second sources and inject fuel into a combustion chamber of the engine. The fuel system further includes a valve operable to selectively direct fuel from the first and second sources to the fuel injector. The fuel system additionally includes a controller in communication with the valve and being configured to affect operation of the valve and a resulting fuel pressure based on a desired injection pressure.

Another aspect of the present disclosure is directed to a method of injecting fuel into a combustion chamber of an engine. The method includes pressurizing fuel to a first pressure, and pressurizing fuel to a second pressure. The method also includes selectively directing fuel at the first pressure and fuel at the second pressure to a fuel injector based on a desired injection pressure. The method further includes injecting the selectively directed fuel.

DETAILED DESCRIPTION

Figure 1:
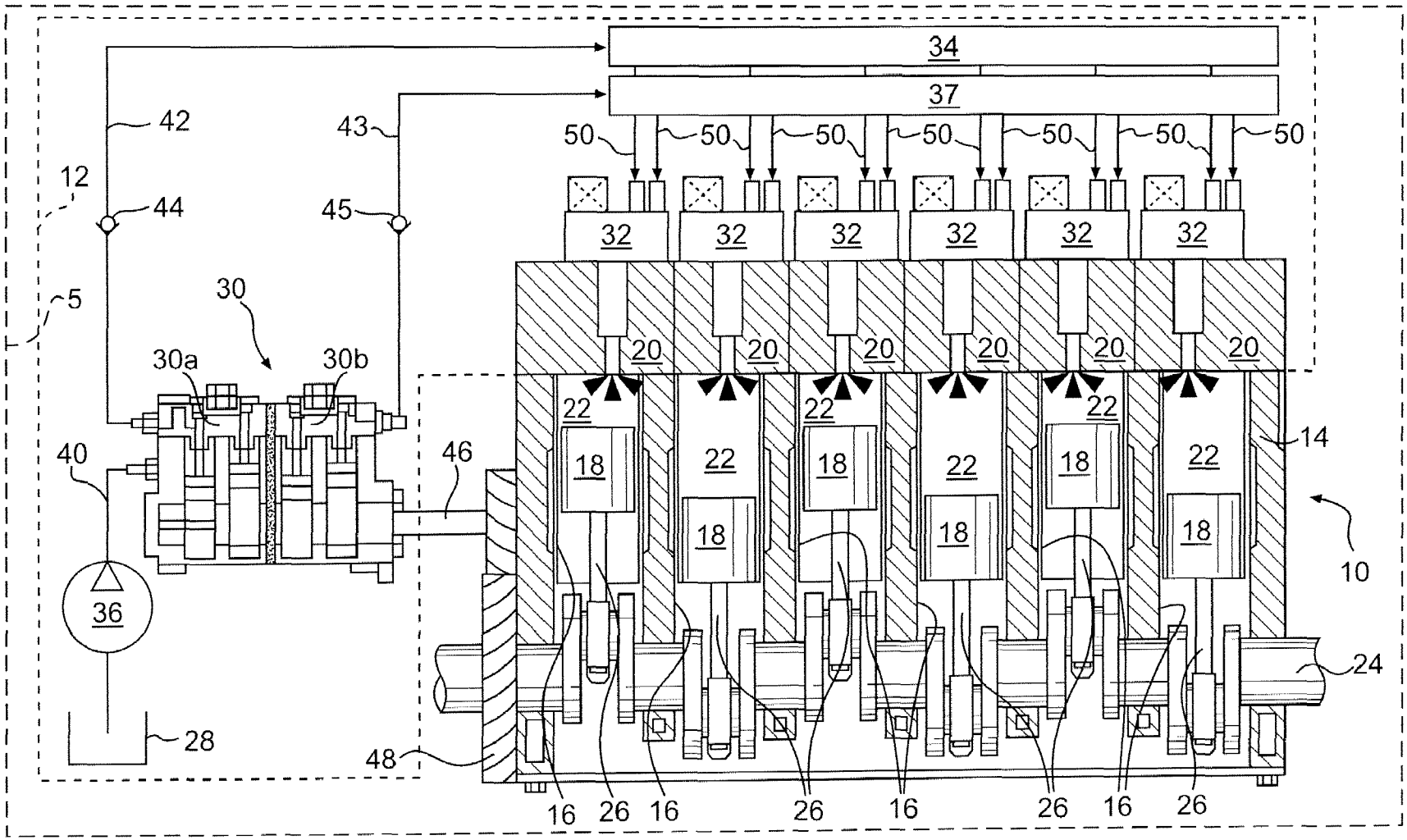
FIG. 1 is a schematic and diagrammatic illustration of an exemplary disclosed engine.

FIG. 1 illustrates a machine 5 having an engine 10 and an exemplary embodiment of a fuel system 12. Machine 5 may be a fixed or mobile machine that performs some type of operation associated with an industry such as mining, construction, farming, power generation, transportation, or any other industry known in the art. For example, machine 5 may embody an earth moving machine, a generator set, a pump, or any other suitable operation-performing machine.

For the purposes of this disclosure, engine 10 is depicted and described as a four-stroke diesel engine. One skilled in the art will recognize, however, that engine 10 may embody any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct one or more flows of pressurized fuel to a plurality of fuel injectors 32. A fuel transfer pump 36 may be disposed within a fuel line 40 between tank 28 and fuel pumping arrangement 30 to provide low pressure feed to fuel pumping arrangement 30.

Fuel pumping arrangement 30 may embody a mechanically driven, electronically controlled pump having a first pumping mechanism 30*a* and a second pumping mechanism 30*b*. Each of first and second pumping mechanisms 30*a, b* may be operatively connected to a pump drive shaft 46 by way of rotatable cams (not shown). The cams may be adapted to drive piston elements (not shown) of first and second pumping mechanisms 30*a, b* through a compression stroke to pressurize fuel. Plungers (not shown) associated with first and second pumping mechanisms 30*a, b* may be closed at variable timings to change the length of the compression stroke and thereby vary the flow rate of first and second pumping mechanisms 30*a, b*. Alternatively, first and second pumping mechanisms 30*a, b* may include a rotatable swashplate, or any other means known in the art for varying the flow rate of pressurized fuel.

First and second pumping mechanisms 30*a, b* may be adapted to generate separate flows of pressurized fuel. For example, first pumping mechanism 30*a* may generate a first flow of pressurized fuel directed to a first common rail 34 by way of a first fuel supply line 42. Second pumping mechanism 30*b* may generate a second flow of pressurized fuel directed to a second common rail 37 by way of a second fuel supply line 43. In one example, the first flow of pressurized fuel may have a pressure of about 100 MPa, while the second flow of pressurized fuel may have a pressure of about 200 MPa. A first check valve 44 may be disposed within first fuel supply line 42 to provide unidirectional flow of fuel from first pumping mechanism 30*a* to first common rail 34. A second check valve 45 may be disposed within second fuel supply line 43 to provide unidirectional flow of fuel from second pumping mechanism 30*b* to second common rail 37.

Fuel pumping arrangement 30 may be operatively connected to engine 10 and driven by crankshaft 24. For example, pump driveshaft 46 of fuel pumping arrangement 30 is shown in FIG. 1 as being connected to crankshaft 24 through a gear train 48. It is contemplated, however, that one or both of first and second pumping mechanisms 30*a, b* may alternatively be driven electrically, hydraulically, pneumatically, or in any other appropriate manner.

Fuel injectors 32 may be disposed within cylinder heads 20 and connected to first and second common rails 34, 37 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center (TDC) position in a compression stroke to allow for compression-ignited-combustion of the injected fuel. Alternatively, fuel may be injected as piston 18 begins the compression stroke heading towards the TDC position for homogenous charge compression ignition operation. Fuel may also be injected as piston 18 is moving from the TDC position towards a bottom-dead-center (BDC) position during an expansion stroke for a late post injection to create a reducing atmosphere for aftertreatment regeneration.

Figure 2:
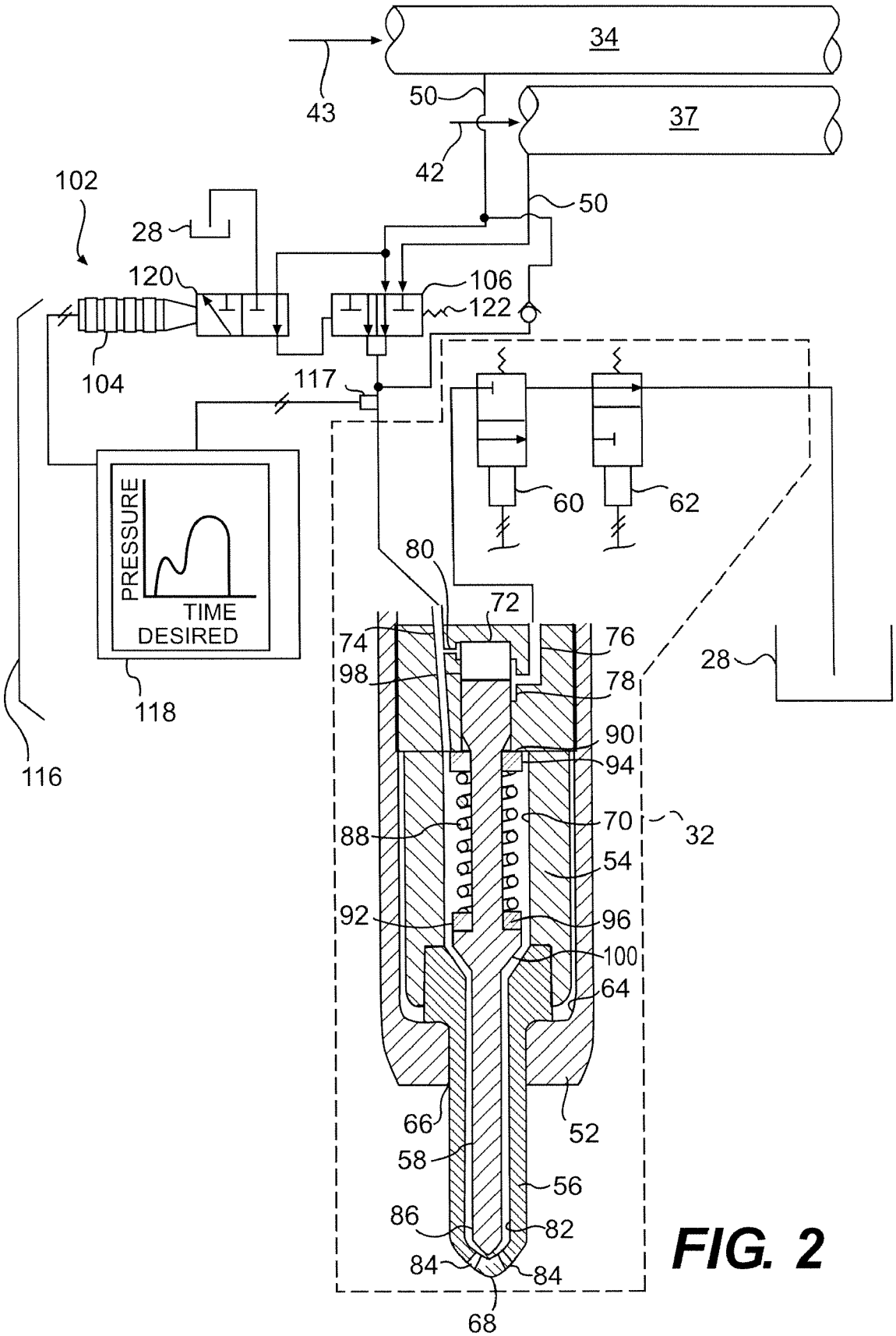
FIG. 2 is a schematic and cross-sectional illustration of an exemplary disclosed fuel system for the engine of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a needle valve element 58, a first solenoid actuator 60, and a second solenoid actuator 62.

Injector body 52 may be a generally cylindrical member configured for assembly within cylinder head 20. Injector body 52 may have a central bore 64 for receiving guide 54 and nozzle member 56, and an opening 66 through which a tip end 68 of nozzle member 56 may protrude. A sealing member such as, for example, an o-ring (not shown) may be disposed between guide 54 and nozzle member 56 to restrict fuel leakage from fuel injector 32.

Guide 54 may also be a generally cylindrical member having a central bore 70 configured to receive needle valve element 58, and a control chamber 72. Central bore 70 may act as a pressure chamber, holding pressurized fuel continuously supplied by way of a fuel supply passageway 74. During injection, the pressurized fuel from fuel line 50 may flow through fuel supply passageway 74 and central bore 70 to the tip end 68 of nozzle member 56.

Control chamber 72 may be selectively drained of or supplied with pressurized fuel to control motion of needle valve element 58. Specifically, a control passageway 76 may fluidly connect a port 78 associated with control chamber 72, and first solenoid actuator 60. Port 78 may be disposed within a side wall of control chamber 72 that is radially oriented relative to axial movement of needle valve element 58 or, alternatively, within an axial end portion of control chamber 72. Control chamber 72 may be continuously supplied with pressurized fuel via a restricted supply passageway 80 that is in communication with fuel supply passageway 74. The restriction of supply passageway 80 may allow for a pressure drop within control chamber 72 when control passageway 76 is drained of pressurized fuel.

Nozzle member 56 may likewise embody a generally cylindrical member having a central bore 82 that is configured to receive needle valve element 58. Nozzle member 56 may further include one or more orifices 84 to allow injection of the pressurized fuel from central bore 82 into combustion chambers 22 of engine 10.

Needle valve element 58 may be a generally elongated cylindrical member that is slidingly disposed within housing guide 54 and nozzle member 56. Needle valve element 58 may be axially movable between a first position at which a tip end 86 of needle valve element 58 blocks a flow of fuel through orifices 84, and a second position at which orifices 84 are open to allow a flow of pressurized fuel into combustion chamber 22.

Needle valve element 58 may be normally biased toward the first position. In particular, each fuel injector 32 may include a spring 88 disposed between a stop 90 of guide 54 and a seating surface 92 of needle valve element 58 to axially bias tip end 86 toward the orifice-blocking position. A first spacer 94 may be disposed between spring 88 and stop 90, and a second spacer 96 may be disposed between spring 88 and seating surface 92 to reduce wear of the components within fuel injector 32.

Needle valve element 58 may have multiple driving hydraulic surfaces. In particular, needle valve element 58 may include a hydraulic surface 98 tending to drive needle valve element 58 toward the first or orifice-blocking position when acted upon by pressurized fuel, and a hydraulic surface 100 that tends to oppose the bias of spring 88 and drive needle valve element 58 in the opposite direction toward the second or orifice-opening position.

First solenoid actuator 60 may be disposed opposite tip end 86 of needle valve element 58 to control the opening motion of needle valve element 58. In particular, first solenoid actuator 60 may include a two-position valve element disposed between control chamber 72 and tank 28. The valve element may be spring-biased toward a closed position blocking fluid flow from control chamber 72 to tank 28, and solenoid-actuated toward an open position at which fuel is allowed to flow from control chamber 72 to tank 28. The valve element may be movable between the closed and open positions in response to an electric current applied to a coil associated with first solenoid actuator 60. It is contemplated that the valve element may alternatively be hydraulically operated, mechanically operated, pneumatically operated, or operated in any other suitable manner. It is further contemplated that the valve element may alternatively embody a proportional type of valve element that is movable to any position between the closed and open positions.

Second solenoid actuator 62 may include a two-position valve element disposed between first solenoid actuator 60 and tank 28 to control a closing motion of needle valve element 58. The valve element may be spring-biased toward an open position at which fuel is allowed to flow to tank 28, and solenoid-actuated toward a closed position blocking fluid flow to tank 28. The valve element may be movable between the open and closed positions in response to an electric current applied to a coil associated with second solenoid actuator 62. It is contemplated that the valve element may alternatively be hydraulically operated, mechanically operated, pneumatically operated, or operated in any other suitable manner. It is further contemplated that the valve element may alternatively embody a three-position type of valve element, wherein bidirectional flows of pressurized fuel are facilitated.

As also illustrated in FIG. 2, one or more pressure control devices 102 may be associated with fuel injectors 32. Specifically, pressure control devices 102 may each include an actuator 104 operatively connected to a valve element 106 and in communication with a control system 116. Valve element 106 may be associated with fuel injector 32, and movable by actuator 104 to selectively combine and/or direct the first and second flows of pressurized fuel to fuel injector 32. It is contemplated that actuator 104 and valve element 106 may be integral with fuel injector 32 or separate as stand alone components.

Actuator 104 may embody a piezo electric device having one or more columns of piezo electric crystals. Piezo electric crystals are structures with random domain orientations. These random orientations are asymmetric arrangements of positive and negative ions that exhibit permanent dipole behavior. When an electric field is applied to the crystals, such as, for example, by the application of a current, the piezo electric crystals expand along the axis of the electric field as the domains line up.

Actuator 104 may be connected to move valve element 106 by way of pilot fluid. In particular, a pilot element 120 connected to actuator 104 may be movable between a first position at which pilot fluid from common rail 34 is communicated with an end of valve element 106, and a second position at which the pilot fluid from the end of valve element 106 is allowed to drain to tank 28. As current is applied to the piezo electric crystals of actuator 104, actuator 104 may expand to move pilot element 120 from the first position toward the second position. In contrast, as the current is removed from the piezo electric crystals of actuator 104, actuator 104 may contract to return pilot element 120 toward the first position. It is contemplated that the piezo electric crystals of actuator 104 may be omitted, if desired, and the movement of pilot element 120 be controlled in another suitable manner. It is further contemplated that actuator 104 may alternatively be directly and mechanically connected to move valve element 106 without the use of pilot element 120, if desired.

Valve element 106 may embody a proportional valve element or other suitable device movable in response to the pilot fluid described above. Specifically, when sufficient pilot fluid from common rail 34 is in contact with the end of valve element 106, valve element 106 may be in or urged toward a first position, at which only the first flow of pressurized fuel is directed to central bore 82. As the pilot fluid is drained away from the end of valve element 106, a spring 122 may bias valve element 120 toward a second position, at which only the second flow of pressurized fuel is directed to central bore 82. Valve element 106 may be movable by way of the pilot fluid to any position between the first and second positions to direct a portion of the first and second pressurized flows of fuel to central bore 82. The amount and ratio of the first or second flows directed by valve element 106 to central bore 82 may depend on the current applied to the piezo electric crystals of actuator 104 and may affect the resultant pressure of the fuel supplied to central bore 82. In addition, the speed of the fluid flowing through pilot element 120 may affect the actuation speed of valve element 120 and the resulting rate at which the injection pressure within central bore 82 changes. This modulating/combining of pressurized fuel may allow for a variable pressure of fuel with central bore 82, resulting in a variable injection rate of fuel through orifices 84 and penetration depth into combustion chamber 22.

Control system 116 may include components that cooperate to regulate the operation of pressure control devices 102 and/or fuel injectors 32 in response to one or more inputs. In particular, control system 116 may include a sensor 117 operatively associated with the combined flow of fuel from pressure control device 102, and a controller 118. Controller 118 may regulate the current applied to actuator 104 in response to signals from sensor 117.

Sensor 117 may embody a pressure sensor configured to sense a pressure of the combined fuel flow exiting pressure control device 102 and to generate a signal indicative of the pressure. It is contemplated that sensor 117 may alternatively sense a different or additional parameter of the fuel associated with the combined fuel flow such as, for example, a temperature, a viscosity, a flow rate, or any other parameter known in the art.

Controller 118 may embody a single microprocessor or multiple microprocessors that include a means for controlling an operation of fuel system 12. Numerous commercially available microprocessors can be configured to perform the functions of controller 118. It should be appreciated that controller 118 could readily embody a general engine microprocessor capable of controlling numerous engine functions. Controller 118 may include a memory, a secondary storage device, a processor, and other components for running an application. Various other circuits may be associated with controller 118 such as power supply circuitry, signal conditioning circuitry, solenoid driver circuitry, and other types of circuitry.

One or more maps relating injection timing and desired injection pressure may be stored in the memory of controller 118. Each of these maps may be in the form of tables, graphs, and/or equations. In one example, injection timing and desired injection pressure may form the coordinate axis of a 2-D table for control of actuator 104. Desired pressure, pilot element position, and/or command current associated with the expansion and contraction of the piezo crystals of actuator 104 may be related in a separate 2-D map. It is also contemplated that the injection timing may be directly related to pilot element position and/or command current in a single 2-D map.

Controller 118 may be configured to receive the signal generated by sensor 117 and operate actuator 104 in response thereto. In particular, controller 118 may be in communication with sensor 117 to receive the signal from sensor 117. Controller 118 may reference the map(s) stored in the memory thereof, compare the signal from sensor 117 to the desired pressure value found in the map(s), and modulate the current directed to the piezo crystals of actuator 104 in response to the comparison. For example, after referencing the relationship map(s) and determining a desired injection pressure, comparing the measured pressure to the desired injection pressure, and determining that the measured pressure is significantly less than the desired pressure (e.g., less than the desired pressure by a predetermined amount), controller 118 may decrease the current supplied to actuator 104, thereby communicating low pressure fuel from common rail 34 with valve element 106 causing valve element 106 to move toward the second position. This movement toward the second position may result in an increase in the pressure of the fuel directed through valve element 106. In contrast, if the comparison indicates that the measured pressure is significantly more than the desired pressure (e.g., more than the desired pressure by a predetermined amount), controller 118 may increase the current supplied to actuator 104, thereby communicating valve element 106 with tank 28 causing valve element 106 to move toward the first position. This movement toward the first position may result in a decrease in the pressure of the fuel directed through valve element 106.

Figure 3:
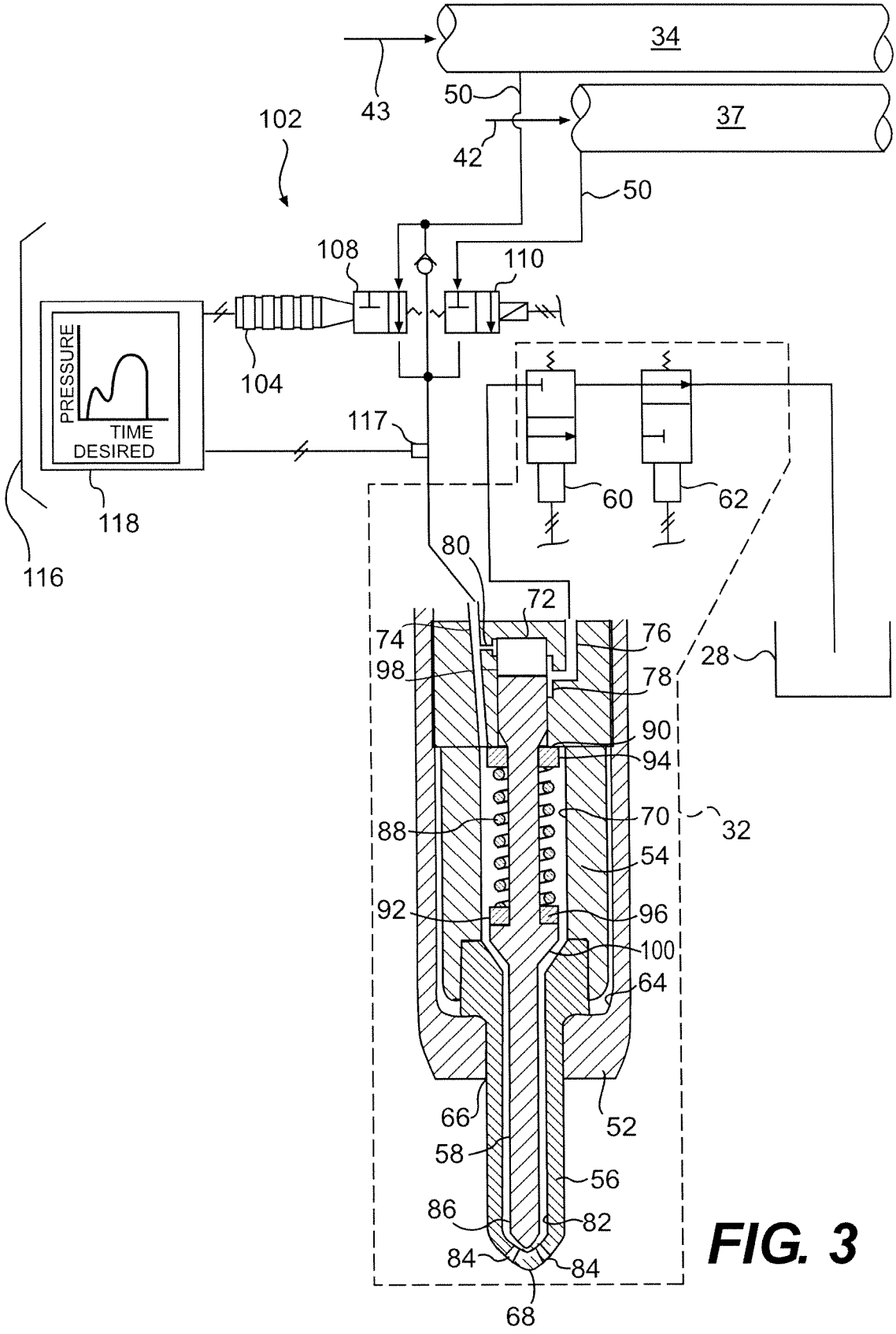
FIG. 3 is a schematic and cross-sectional illustration of another exemplary disclosed fuel system for the engine of FIG. 1.

FIG. 3 illustrates an alternative embodiment to fuel system 12 of FIG. 2. Similar to fuel system 12 of FIG. 2, fuel system 12 of FIG. 3 may include fuel injector 32 receiving flows of pressurized fuel from first and second common rails 34 and 37 via fuel line 50 and actuator 104. However, in contrast to the single valve element 106 associated with actuator 104 depicted in FIG. 2, actuator 104 of FIG. 3 may include two separate valve elements 108 and 110.

During an injection event when the first and second flows of pressurized fuel are directed through valve element 106 (referring to FIG. 2), it is possible for the higher pressure fuel from first common rail 37 to flow in reverse direction into second common rail 34. This reverse flow can reduce the efficiency of fuel system 12. To improve the efficiency of fuel system 12, actuator 104 of FIG. 3 may implement separate valve elements 108 and 110.

Similar to valve element 106, valve element 108 may embody a proportional valve element or other suitable device movable by actuator 104. Although illustrated in this embodiment as actuator 104 being directly and mechanically coupled to valve element 108, it is contemplated that actuator 104 may alternatively be indirectly connected to valve element 108 by way of a pilot element (not shown) similar to pilot element 120 of FIG. 2. Valve element 108 may be movable between a first position at which pressurized fuel from second common rail 37 is blocked from fuel injector 32, and a second position at which a maximum amount of fuel from second common rail 37 is directed to fuel injector 32. Valve element 108 may also be movable to any position between the first and second positions to direct a portion of the second pressurized flow of fuel to fuel injector 2. The amount of the second flow of pressurized fuel from second common rail 37 directed by valve element 108 to fuel injector 32 may correspond to the current applied to the piezo electric crystals of actuator 104.

In contrast to valve element 108, valve element 110 may embody a two-position, solenoid-actuated valve element. Valve element 110 may be movable from a first position at which substantially no pressurized fuel from first common rail 34 is directed to central bore 82, to a second position at which a maximum amount of fuel from the first common rail 34 is directed to fuel injector 32. Valve elements 108 and 110 may be separately or simultaneously operated to independently direct pressurized fuel from either the first common rail 34, the second common rail 37, or both of the first and second common rails 34, 37. This combining of pressurized fuel from first and second common rails 34, 37 may allow for a variable pressure of fuel with central bore 82, resulting in a variable injection rate of fuel through orifices 84 and penetration depth into combustion chamber 22.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine that utilizes a pressurizing fuel system wherein it may be advantageous to provide a variable pressure supply of fuel and to precisely know and control the pressure of fuel injection. The operation of fuel system 12 will now be explained.

Needle valve element 58 may be moved by an imbalance of force generated by fuel pressure. For example, when needle valve element 58 is in the first or orifice-blocking position, pressurized fuel from fuel supply passageway 74 may flow into control chamber 72 to act on hydraulic surface 98. Simultaneously, pressurized fuel from fuel supply passageway 74 may flow into central bores 70 and 82 in anticipation of injection. The force of spring 88 combined with the hydraulic force generated at hydraulic surface 98 may be greater than an opposing force generated at hydraulic surface 100 thereby causing needle valve element 58 to remain in the first position to restrict fuel flow through orifices 84. To open orifices 84 and inject the pressurized fuel from central bore 82 into combustion chamber 22, first solenoid actuator 60 may move its associated valve element to selectively drain the pressurized fuel away from control chamber 72 and hydraulic surface 98. This decrease in pressure acting on hydraulic surface 98 may allow the opposing force acting across hydraulic surface 100 to overcome the biasing force of spring 88, thereby moving needle valve element 58 toward the orifice-opening position.

To close orifices 84 and end the injection of fuel into combustion chamber 22, second solenoid actuator 62 may be energized. In particular, as the valve element associated with second solenoid actuator 62 is urged toward the flow blocking position, fluid from control chamber 72 may be prevented from draining to tank 28. Because pressurized fluid is continuously supplied to control chamber 72 via restricted supply passageway 80, pressure may rapidly build within control chamber 72 when drainage through control passageway 76 is prevented. The increasing pressure within control chamber 72, combined with the biasing force of spring 88, may overcome the opposing force acting on hydraulic surface 100 to force needle valve element 58 toward the closed position. It is contemplated that second solenoid actuator 62 may be omitted, if desired, and first solenoid actuator 60 used to initiate both the opening and closing motions of needle valve element 58.

Pressure control device 102 may affect pressure of the fuel supplied to central bores 70 and 82, and subsequently injected into combustion chamber 22. Specifically, in response to a current applied to the piezo electric crystals of actuator 104, actuator 104 may affect movement of valve elements 106 (referring to FIG. 2) and 108 (referring to FIG. 3) to increase or decrease the amount of pressurized fuel flowing from second common rail 37 into fuel injector 32. With regard to the embodiment of FIG. 2, the movement of actuator 104 may also simultaneously control the amount of pressurized fuel flowing from first common rail 34 into fuel injector 32. In contrast, with regard to the embodiment of FIG. 3, valve element 110 may be independently controlled to allow or block the flow of fuel from first common rail 34 into fuel injector 32.

Controller 118 may enable precise control over the pressure of a fuel injection event. In particular, during different stages of injection (pilot, main, post, etc.), it may be desirable to change the pressure of the injected fuel. To accomplish this pressure change, controller 118 may reference the relationship map(s) stored in the memory thereof and determine a desired pressure corresponding to the current timing stage of fuel injector 32. This desired pressure may then be compared by controller 118 to the signal from sensor 117 and determine an error value. If the error value exceeds a predetermined value, controller 118 may modulate the current supplied to actuator 104, thereby varying the ratio of low pressure fuel to high pressure fuel directed through valve element 106 (referring to the embodiment of FIG. 2) or through valve elements 108 and 110 (referring to the embodiment of FIG. 3).

This change in the flow rates of fuel from first and second common rails 34, 37 may directly and immediately affect the pressure of fuel within central bores 70 and 82. For example, an increased current applied to actuator 104 may cause a decrease in the flow rate of pressurized fuel from second common rail 37 and a resulting lower pressure of fuel within central bores 70 and 82. In contrast, a decreased current applied to actuator 104 may cause an increase in the flow rate of pressurized fuel from second common rail 37 and a resulting higher pressure of fuel within central bores 70 and 82. With regard to FIG. 2, the changes in flow rate of pressurized fuel from second common rail 37 may simultaneously correspond to an inverse change in flow rate of pressurized fuel from first common rail 34. With regard to FIG. 3, the flow rate of pressurized fuel from first common rail 34 may be independently controlled via solenoid-actuated valve element 110.

Because fuel system 12 may vary the pressure of injected fuel by combining and/or directing two different flows of pressurized fuel to a single injector, the number of different levels of fuel pressure available for injection may be infinite. In particular, fuel system 12 may not be limited to specific predetermined pressure levels. This flexibility in the pressure of injected fuel may extend the use of fuel system 12 to different applications, as well as the operational range and efficiency of engine 10. In addition, this flexibility may allow compliance with emission standards under a wider range of operating conditions.

Further, because fuel system 12 may vary the pressure of injected fuel with a minimal number of additional components, the complexity and cost of fuel system 12 may be low. Specifically, the addition of pressure control device 102 may add very little complexity or cost to fuel system 12.

In addition, because of the configuration of fuel system 12, the responsiveness of fuel system 12 may be high. In particular, because the pressure of the fuel directed through valve elements 106 or through valve elements 108 and 110 may be regulated based on a measured pressure immediately downstream of the valve elements, very little lag between desired fuel pressure and actual injected fuel pressure may exist. This increased responsiveness may result in higher fuel efficiency, lower exhaust emissions of engine 10, and improved responsiveness of machine 5.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel system for an engine, comprising:

a first fuel rail at a first pressure;

a second fuel rail at a second pressure;

a fuel injector configured to receive fuel from the first and second fuel rails and inject a single, combined flow of fuel into a combustion chamber of the engine;

a valve operable to selectively vary the ratio of the fuel from the first and second rails to form the single, combined flow of fuel;

a controller in communication with the valve and being configured to affect operation of the valve and a resulting fuel pressure based on a desired injection pressure; and a pressure sensor configured to provide a signal indicative of the pressure of fuel being injected, wherein the controller is configured to further affect operation of the valve and the resulting fuel pressure in response to the signal.

2. The fuel system of claim 1, wherein the pressure sensor is disposed between the valve and a tip of the fuel injector.

3. The fuel system of claim 1, wherein the valve is integral with the fuel injector.

4. The fuel system of claim 1, wherein the valve includes a main valve element movable between a first position at which fuel from only the first rail is communicated with the fuel injector, and a second position at which fuel from only the second rail is communicated with the fuel injector.

5. The fuel system of claim 4, wherein:

the valve further includes a pilot valve element and a piezo device;

the piezo device is configured to move the pilot valve element between a first position at which pilot fluid is selectively communicated with an end of the main valve element, and a second position at which the pilot fluid is drained from the end of the main valve element; and the controller is in communication with the piezo device to control movement of the pilot valve element between the first and second positions.

6. The fuel system of claim 5, wherein a flow rate of fuel through the pilot valve corresponds with a rate of fuel pressure change during injection from the first pressure to the second pressure.

7. The fuel system of claim 1, wherein the fuel injector includes a valve configured to initiate fuel injection.

8. The fuel system of claim 7, wherein the controller includes a memory having a map stored thereon relating the desired fuel injection pressure to a current timing of the fuel injector valve.

9. A method of injecting fuel, comprising:

maintaining a fuel rail at a first pressure;

maintaining a second fuel rail at a second pressure;

selectively adjusting the ratio of fuel at the first pressure to fuel at the second pressure to direct a flow of fuel at a third pressure to a nozzle member of an injector based on a desired injection pressure;

injecting the fuel at the third pressure; and measuring a pressure of the fuel at the third pressure, wherein the step of selectively adjusting is also based on the measured pressure of the fuel at the third pressure.

10. The method of claim 9, wherein the step of selectively adjusting includes directing current to a piezo device to allow pilot fluid to drain from a valve element.

11. The method of claim 9, further including referencing a relationship map to determine the desired injection pressure based on a current timing in a fuel injection cycle.

12. A machine, comprising:

an engine configured to generate a power output, the engine having at least one combustion chamber;

a fuel injector configured to inject fuel into the at least one combustion chamber;

a first source of fuel at a first pressure;

a second source of fuel at a second pressure;

a valve operable to selectively combine fuel from the first and second sources and communicate the combined fuel with the fuel injector;

a pressure sensor configured to provide a signal indicative of the pressure of fuel being injected; and a controller in communication with the valve and the pressure sensor, the controller being configured to affect operation of the valve and a resulting combined fuel pressure based on a desired injection pressure and the signal.

13. The machine of claim 12, wherein the valve includes:

a main valve element movable between a first position at which fuel from only the first source is communicated with the fuel injector, and a second position at which fuel from only the second source is communicated with the fuel injector;

a pilot valve element; and a piezo device, wherein:

the piezo device is configured to move the pilot valve element between a first position at which pilot fluid is selectively communicated with an end of the main valve element, and a second position at which the pilot fluid is drained from the end of the main valve element; and the controller is in communication with the piezo device to control movement of the pilot valve element between the first and second positions.

14. The machine of claim 12, wherein the valve includes:

a first valve element associated with the first source of pressurized fuel and being movable from a first position at which fuel from the first source is communicated with the fuel injector, to a second position at which fuel from the first source is blocked from the fuel injector; and a second valve element associated with the second source of pressurized fuel and being movable between a first position at which fuel from the second source is communicated with the fuel injector, and a second position at which fuel from the second source is blocked from the fuel injector, wherein the control is configured to move the second valve element to a position between the first and second positions based on the desired injection pressure.

15. The machine of claim 12, wherein:

the valve is integral with the fuel injector; and the fuel injector includes at least a second valve configured to initiate fuel injection.

* * * * *